United States Patent [19]

van Roon

[11] 4,449,471

[45] May 22, 1984

[54] STEERING COMBINATION OF PUSHER TUG AND BARGES

[76] Inventor: Johannes van Roon, A 74, 2975 BC Ottoland, Netherlands

[21] Appl. No.: 215,913

[22] Filed: Dec. 12, 1980

[30] Foreign Application Priority Data

Dec. 13, 1979 [NL] Netherlands ..... 7908998

[51] Int. Cl.[3] ..... B63B 21/62

[52] U.S. Cl. ..... 114/249; 114/251

[58] Field of Search ..... 114/77 R, 77 A, 219, 114/242, 246–252

[56] References Cited

U.S. PATENT DOCUMENTS

| | | | |
|---|---|---|---|
| 922,160 | 5/1909 | Lane | 114/246 |
| 3,035,537 | 5/1962 | Smith | 114/246 |
| 3,257,985 | 6/1966 | Glosten | 114/250 |
| 3,830,186 | 8/1974 | Janssen | 114/249 |
| 3,890,916 | 6/1975 | Tummers | 114/219 |
| 3,954,078 | 5/1976 | Garcia | 114/249 |

*Primary Examiner*—Sherman D. Basinger

*Attorney, Agent, or Firm*—Martin Smolowitz

[57] ABSTRACT

The invention relates to a combination of a pusher tug and one or more barge units, whereby each barge unit may comprise one or more barges coupled alongside each other. Between the barge units and/or between the rear-unit and the pusher tug, pivotable pushing connections are installed giving the combination an articulated character. Each of the pivotable pushing connections is only mounted to one of the units or to the pusher tug and is coupled to the opposite unit with usual connections, such as steel wires. The pivotable pushing connections are robust and easy to handle by the normal deck crew. Application of the pivotable and steerable pushing connections increases the safety of pushing traffic on waterways and allows more units per combination.

20 Claims, 6 Drawing Figures

STEERING COMBINATION OF PUSHER TUG AND BARGES

BACKGROUND OF INVENTION

The invention relates to steerable pushing means for a combination of a pusher tug with barges, which combination consists of a pusher tug with at least one barge unit, whereby each unit may comprise one, two or more barges coupled alongside each other, and the pusher tug has at least one propelling mechanism, and the combination comprises at least one steerable pushing means, consisting of a horizontal support frame connected to the stem, which support frame carries and guides a pushing beam pivotable around a vertical shaft and positioned perpendicular to the centerline of the combination and whereby for steering purposes at both sides of the pivot shaft a jack or similar extendable or retractable means is installed between the support frame and the pushing beam.

Sailing with combinations of a pusher tug and barges on rivers, as for instance the river Rhine, with many ship movement and a number of relatively sharp curves, not only requires good steersmanship, but besides that is also influenced by the other ship movements on the waterway. The result thereof is that the supervisors of these waterways have set limits, not only to the width, but especially to the length of such combinations. On the river Rhine for instance, combinations with up to two times two barges are allowed, which means a unit consisting of two barges coupled board to board alongside each other followed by a similar unit with the pusher tug thereafter at the center line. Notwithstanding the relatively low water depth, the pushing tugs are capable to deliver sufficient propelling power for transporting combinations of three times two barges, that means three units, or even more. However, the manoeuverability of such a stiff combination is doubtful. In such a combination all the barges are mutually stiff coupled to each other using crosswires, longitudinal wires and tranverse wires. Also the pusher tug is stiff coupled behind the barges. By means of an additional front rudder it is possible to improve the steerability in some way and by means of a front screw which may act to the starboard side or to the portside a stronger improvement is possible. The object of the invention is to realise with very simple means a much more important contribution to the improvement of the steerability of combinations of this type, such that running longer combinations consisting of five or six barges in three units will become a possibility.

Steerable pushing means as described in the heading are known from the U.S. Pat. No. 3,035,537. By means of the system described in said publication a pusher tug is stiff but also movable coupled to a barge. Said coupling is realised by means of pivot pins at the barge side, which barge should comprise therefore separate connecting elements. The described steerable pushing means are intended for light applications as appears from the construction and the examples. Using a similar construction in a combination of a pusher tug and barges with units of thousands of tons in the rough professional transport business on rivers as the river Rhine for transporting for instance coal and ore seems out of the question. One of the problems thereby is without doubt the coupling of the described pushing means to the barges and the decoupling therefrom, whereby furthermore the vulnerability of the connecting means onto the stern of the barges is unacceptable for the intended application.

SUMMARY OF INVENTION

The object of the invention is now to provide steerable pushing means which are simple although very robust and which may be handled by the small deck crew without difficulties during coupling and decoupling. A further object of the invention is to increase the application possibilities. According to the invention the steerable pushing means described in the heading are characterized in that the whole pushing means are only connected to one of the coupled units (pushing tub and/or barge unit), that the pushing means have at least one stemson and that always one stemson is positioned onto the centerline of the pushing means functioning as central stemson suited to cooperate with the pivot shaft of the pushing beam, that the pushing means have a considerable vertical extension substantially in the stemson areas, that the pushing means are bounded at the coupling side by the substantially flat pushing surface of the pushing beam and that the coupling is realised with longitudinal and tranverse wires between the pushing beam and the unit in a way usual for stiff combinations.

The pushing means according to the invention are suited for positioning not only between a pusher tug and a barge or barge unit, but also between barges or barge units themselves, in which case an optimal steerability is attainable. Under circumstances the desired steerability may also be attained by positioning the steerable pushing means exclusively between one or more barge units whereby the pusher tub itself can be stiff coupled. The U.S. Pat. No. 3,035,537 illustrates the usual pusher tug, steered by means of rudders, but when using the steerable pushing means even removal of the rudders is possible.

In a number of cases it might be advantageous that the support frame is parallel to itself and adjustable in height along vertical guiding elements mounted onto the stemsons. In that case, it is possible to balance an eventual height difference between loaded and unloaded barges and between barges and the pusher tug. Such height difference can amount a number of meters.

A further object of the invention is to use substantially the same pushing means between a pusher tug at the one hand, and a barge or barge unit at the other hand or between the barges or units themselves. For that purpose the steerable pushing means are, if they are connected to the pusher tug, characterized in that the vertical guiding elements are positioned onto the pusher tug, one at the starboard stemson and the other at the portside stemson, which vertical guiding elements are adapted for absorbing horizontal forces in all directions.

A preferred embodiment is characterized in that the pushing beam is supported by means of substantially horizontal struts directed to the centerline of the pusher tug, where the struts are connected to a vertical cylindrical column resting as pivot shaft into a vertical cylindrical trough functioning as counter pivot element, which trough is connected to the stem of the pusher tug by means of a vertical central stemson extended downwards with the cutwater, whereby at the side of the pushing beam said cylindrical column is pivotably locked in said trough by the support frame.

In case the pushing means are connected to one barge or to two barges, which are coupled alongside each other, then the pushing means are in a similar way characterized in that a substantially horizontal front adapter stem is positioned between the stem(s) carrying the whole pushing means and the pushing means, which front adapter stem supports the vertical guiding elements at the starboard side and the portside.

As result of the use of a front adapter stem, it is possible to dismountably connect the pushing means to one or more barges and therefore to use and remove said pushing means at wish. It is, for instance during loading and unloading of one barge, possible to install the dismountable pushing means with separate front adapter stem onto another barge which is ready for transport. According to a further embodiment, the pushing means are characterized in that the front adapter stem is mounted onto the deck of the barge (unit) by means of two horizontal carrying elements pivotable around a vertical shaft, whereby carriage bolts inserted with some clearance into cavities are forming a loosable connection, and that the front adapter stem could be extended downwards in which case said front adapter stem is leaning against a broad cutwater onto the stem of the barge(s).

Because such pushing means, and certainly those pushing means having a front adapter stem, are intended for handling a number of heavy barges using pusher tugs with installated power of thousands of kilowatts, such means are heavy and expensive. Especially the transport of such pushing means, the installation on and the removal thereof from barges will be practically impossible without suitable aids. According to a preferred embodiment of the invention, both pushing means are for this purpose adapted such that it is possible to handle the one pushing means using the pushing means onto the pusher tub. In that case the pushing means are characterized in that the pushing beam and the struts of the pushing means between two barge units comprise at their underside supporting surfaces in a horizontal plane and a downwards directed pin and that the upper surface of the pushing means onto the pusher tug are substantially flat and horizontal and comprise an intake opening, all this such that the pusher tug is capable to remove, transport and place the pushing means destined for positioning between the barges with help of his own elevatable pushing means, whereby the horizontal surfaces are resting onto each other and the pin is inserted into the intake opening.

With the pushing means according to the invention, it is possible to adapt barges at the one hand for use into a combination of barges comprising the steerable pushing means according to the invention, but on the other hand the barges could be used in the classical stiff combination of barges. It is furthermore pointed out that the pushing means according to the invention are coupled to the barges in the classical way with help of longitudinal wires and cross wires. In case the pushing means are used between a pusher tug and consisting barges, it is therefore not necessary to alter some barges in any way. Only in case the pushing means according to the invention are used with a front adapter stem between the barges themselves, then the barge should have means to mount said front adapter stem. However, said means could be simply installed into the deck and are configurated such that said means in the absence of the pushing means are not forming obstacles on the barges. Therefore it is possible to use the barges also in the classical stiff combination.

Furthermore it is naturally possible to equip a combination of barges and a pusher tug comprising the pushing means according to the invention, with a front rudder or a front screw.

The Dutch Patent Application No. 7100162 describes a steering system. The object of this publication is to use a normal tug for pushing a barge, which normal tug is for that occasion used as pusher tug. The stem of the tug is for that purpose equipped with a pushing adapter of which the function is comparable to the function of the known stemsons of the purpose built pusher tugs. However, because a tug or a pusher tug has an approximately constant draft, whereas the barges could have a draft difference in the loaded or unloaded condition of some meters, according to the above mentioned patent application a vertical guiding system is mounted onto the stem of the barge. When using this system each barge therefore should comprise the necessary guiding and mounting means. To make the tugboat steerable in relation to the barge, the connection between the stem of the pusher tug and the adjustable pushing beam on the barge has a pivotable configuration. To assist and secure the steering feature, so-called side wires are attached in the usual way between the starboard and portside corners of the barge and the boards of the pusher tug, and the length of said wires may be increased or decreased for instance by means of winches. By increasing and decreasing the length of said side wires, it is possible to adjust the corner between the centerline of the pusher tug and the centerline of the barge. An important drawback of said known system is that relatively expensive and bulky aids should be installed on the barge resulting into an increase of costs, a considerably increased chance of damage and furthermore a more laborous handling.

There are other systems known for pivotably connecting a tug or pusher tug to a barge. These systems, however, are adapted for coupling to and transporting over short distance barges of for instance the Lash- or Seabee-type which are floating free in the water.

DESCRIPTION OF INVENTION

Further characteristics of the invention will be explained in more detail based on the following figure description of a preferred embodiment of the steerable pushing means according to the invention.

Figure 1:
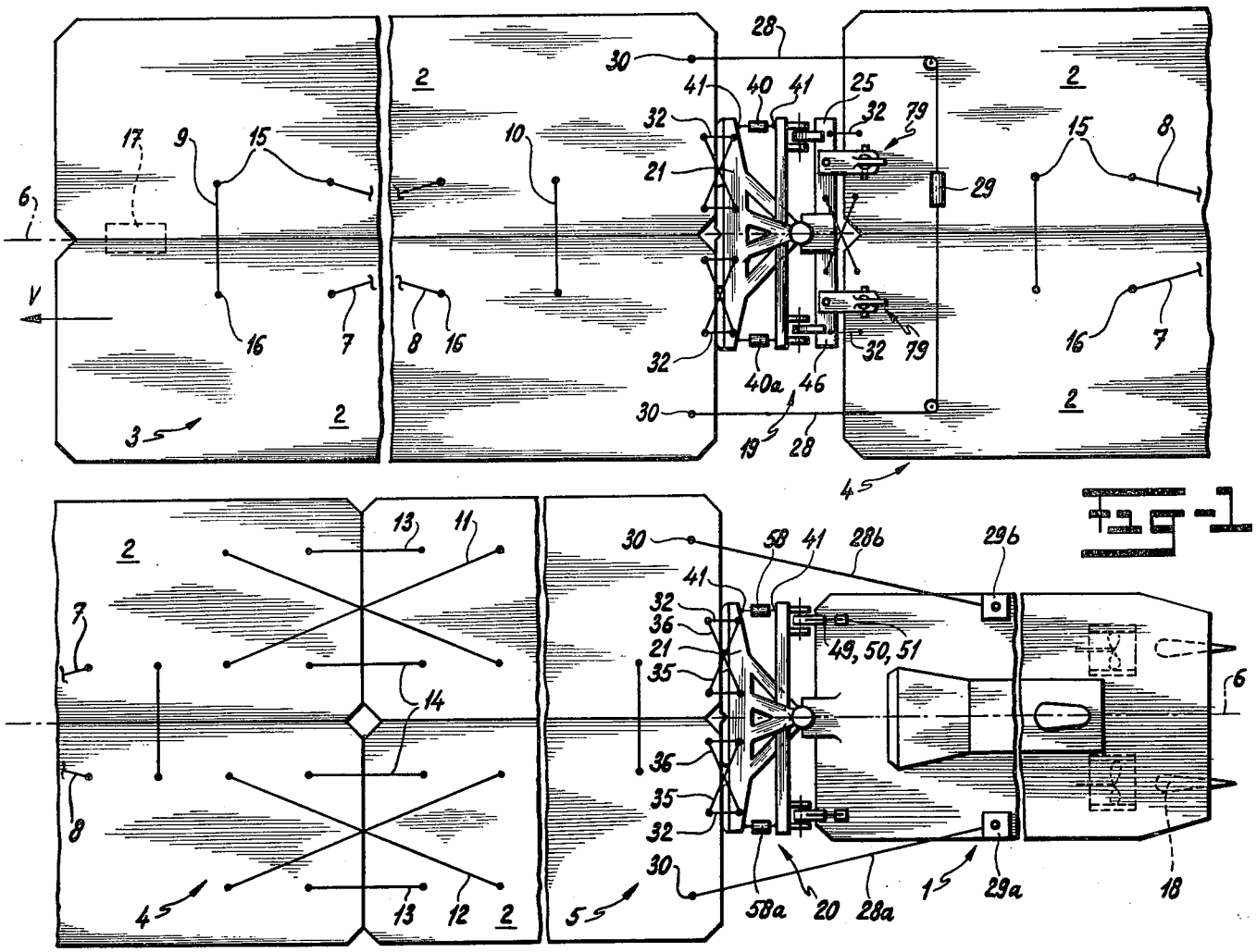
FIG. 1 illustrates a combination of a pusher tug and barges comprising the steerable pushing means according to the invention.

FIG. 1 illustrates a combination consisting of a pusher tug 1, preceded by three units 3, 4, 5, each consisting of two barges 2, coupled board to board alongside each other. The units 4 and 5 are stiff coupled to each other in length-direction, whereas between the units 3 and 4 steerable pushing means according to the invention are positioned. Also between the stem of the pusher tug 1 and the backside of the unit 5 similar steerable pushing means according to the invention are positioned.

The two barges 2 of which a unit 3, 4 or 5 consists, are coupled board to board in the classical way using two cross wires 7 and 8 and two transverse wires 9 and 10. This is shown for the unit 3 and it will be clear that the units 4 and 5 have a corresponding coupling. For this purpose on the deck 44 of the barges 2 the necessary bollards, hawses, capstans and/or winches are installed, as is schematically illustrated with 15 and 16. The reference number 15 denotes for instance a bollard for fixing a wire, for instance 8 or 9, whereas the other end of said wire is attached to a mechanical drawing tool such as a capstan or winch 16. An experienced deck crew is capable to couple barges alongside each other and behind each other with reasonable precision regardless of current and wind. Absolute precision and alignment alongside each other and behind each other is thereby not required and will only be attained accidently. Taking the crosswires 11 and 12 and the longitudinal wires 13 and 14 as example in FIG. 1 the units 4 and 5 are coupled behind each other. In the known barge combinations all the barges are coupled to each other in the described manner and are also coupled in the same manner to the pusher tug. The steering of such a combination is performed by means of the usual rudders or rotatable jet pipes 18 under the pusher tug 1. In general, the combination comprises a front rudder or front screw, schematically denoted with 17. Such a combination forms a stiff construction along the centerline 6—6.

The invention now allows adapting the centerline 6—6 to a sailed curved course, for which purpose the stiff connection between succeeding units is in one or more positions altered into a pivotable connection. According to FIG. 1 this is done with the connection 19 between the units 3 and 4 and the connection 20 between the rear barge unit 5 and the pusher tug 1. The connection 20 between the pusher tug 1 and the barge unit 5 will be discussed in more detail. The pivotable connection 19 between the barges or barge units themselves is for the most part identical therewith.

The pivotable connection 20 will be explained referring to FIGS. 1, 2, 3 and 4. The pivotable connection 20 is as a whole mounted to the front side of the pusher tug 1. The connection comprises a pusher beam 21 pivotable around the pivot shaft mounted through guiding elements 68 at the starboard side and the port side to stemsons 50. By means of the guiding elements 68, the pivotable pushing means 20 may be adjusted in vertical direction depending onto the load condition of the rear barge unit 5. It is thereby possible to bring the pushing beam 21 at the same height of the stern post(s) of the unit 5. The pushing beam 21 is coupled to the unit 5 in the classical way with help of longitudinal wires 32 and crosswires 35, 36. In the longitudinal direction of the combination and in transversal direction, the coupling is therefore practically stiff although the wires will have some elasticity. Referring to the rotation of the pusher tug in relation to the combination of barges 5 along the centerline of said combination there is some freedom of movement left which is sufficient according to standing practice. Furthermore, a pusher tug comprising the pivotable pushing means according to the invention can be coupled by the deck crew in the well known way.

Between the pushing beam 21 and the stern post(s) of the combination of barges 5 the usual fenders 60 can be positioned. With help of the struts 61, 62, 63 and 64 the pushing beam is stiff connected to the vertical cylindrical column 65. The centerline of said column 65 defines the pivot axis S—S of the pushing means according to the invention. The struts 61 and 62 are extending horizontally, whereby the upper surfaces thereof are in the same plane as the upper surface of the pushing beam 21. Between the struts 61, 62 and 63, 64 and in front of the column 65, there is an opening through which the upper beam 46 of a support frame extends. Said support frame comprises two parallel horizontal beams 46 and 66, which are together with a number of vertical connecting columns 67 combined into a stiff construction. The beam 46 of said support frame is carrying with its upper surface the weight of the pushing beam 21 together with the weight of the struts and the column 65. Although not illustrated in the figures, it is possible to coat the upper surface of the support frame beam 46 and the under surface of the struts 61 and 62 with a friction and wear decreasing coating.

Figure 4:
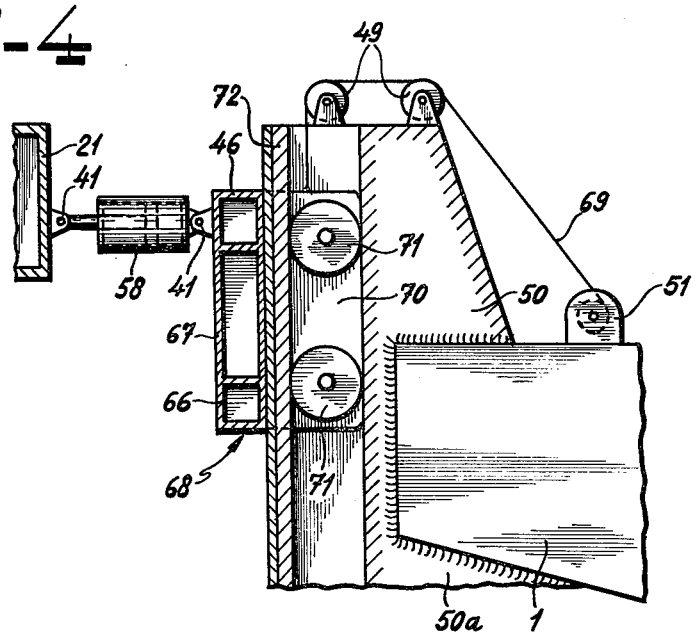
FIG. 4 illustrates a sectional view according to the line 4—4 in FIG. 2.

The support frame 46, 66, 67 comprises at the starboardside end and at the portside end vertical guiding elements 68. Said guiding elements each consists of a fork-shaped element 70 and two sets of bearing rollers 71 pivotable around horizontal shafts between the fork-shaped legs of the element 70. Said bearing rollers are running into oppositely positioned troughs in the element 72 with H-shaped profile, extending into vertical direction in front of the stemsons 50. The rollers 71 are fitting with small clearance into the recesses into the H-shaped profile element, whereas as is illustrated in FIG. 4 the fork-shaped element 70 is extending in vertical direction to such a length, that it is possible to position two sets of rollers 71 above each other. A guiding element 68 of such construction is only capable of moving in vertical direction, whereas translations and rotations in all other directions are impossible. The support frame 46, 66, 67 is therefore locked with respect to the pusher tug 1 such that only a movement in vertical direction is possible. According to FIG. 4 said vertical movement of the support frame and inherently the vertical movement of the pushing beam with struts and column 65 is controlled by the wire 69 running over two schematically denoted rollers 49 to an also schematically denoted winch 51, positioned onto the deck of the pusher tug 1. It is possible to mount said rollers 49 by means of brackets onto the stemsons 50. Between the front of the H-shaped guiding elements 72 and the opposite part of the fork-shaped element 70, a schematically denoted fender can be installed for compensation of the clearance on the one hand and noise damping on the other hand.

Figure 3:
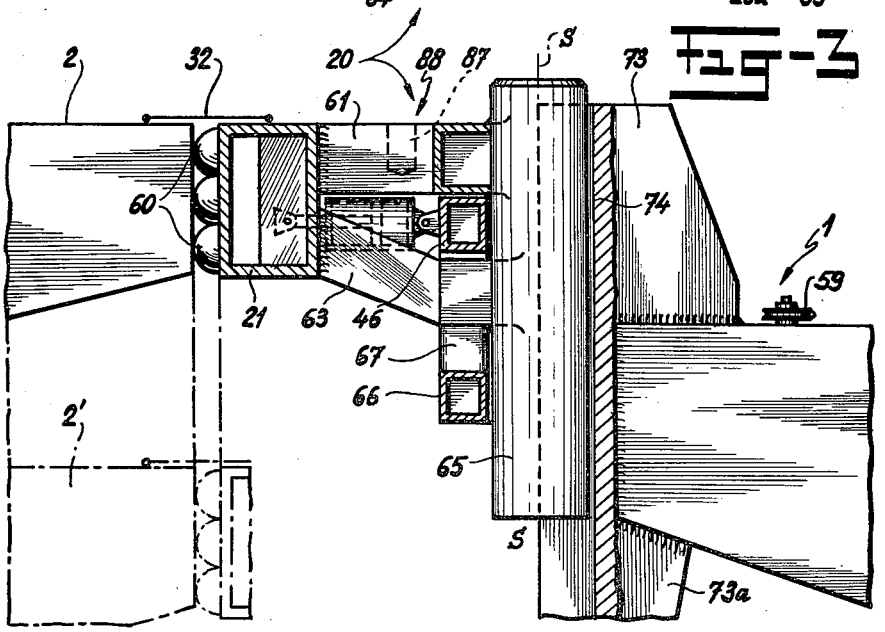
FIG. 3 illustrates a sectional view according to the line 3—3 in FIG. 2.

Between the ends of the pushing beam 21 and the beam 46 of the support frame, hydraulic jacks 58 and 58*a* are installed at the starboardside as well as the portside, which jacks are pivotably coupled at 41. Said jacks 58 are preferably double acting and under opposite control, these jacks are capable to rotate the pushing beam around the pivot axis S—S in relation to the support frame and to the pusher tug. The transfer of pushing power between the pusher tug 1 and the barges 2 can be partly carried out through said jacks 58. The complete pushing power can be transferred through the struts 61–64 and the cylindrical column 65 to the central stemson 73, which is positioned vertical into the centerline of the pushing tug and the stem thereof. To prevent wear and to improve the gliding capability it is possible to provide the semi circular vertical trough with a coating 74*a*. The length of the trough 74 in the central stemson 73 is such that over the whole vertical displacement path of the pushing means 20 the column 65 is guided in said trough. For that purpose in many cases the central stemson 73 will be extended until near the water line or under the water line with the schematically denoted cutwater 73*a*. In FIG. 3 it is schematically denoted where, based on a constant water level, the barge 2 is positioned in the loaded and in the unloaded condition. At lower left FIG. 3 the completely loaded position of the barge is indicated at 2'. Therefore it must be possible to lower the pushing means 20 until said level, which level therefore is also defining the vertical extension in downwards direction of the cutwater 73*a*. It will be clear that the guiding elements 72 as is indicated in FIG. 4 should allow the same vertical displacement as is allowed by the central stemson/cutwater combination 73, 73*a*. Furthermore it will be clear that the vertical displacement control means 49, 51, 69, which are schematically indicated in FIG. 4, may be replaced by other known means as for instance an hydraulic jack or a combination of a screw spindle and cooperating nut. Naturally the operation of the elevating means at starboardside is synchronized with the operation of the boardside means.

Figure 2:
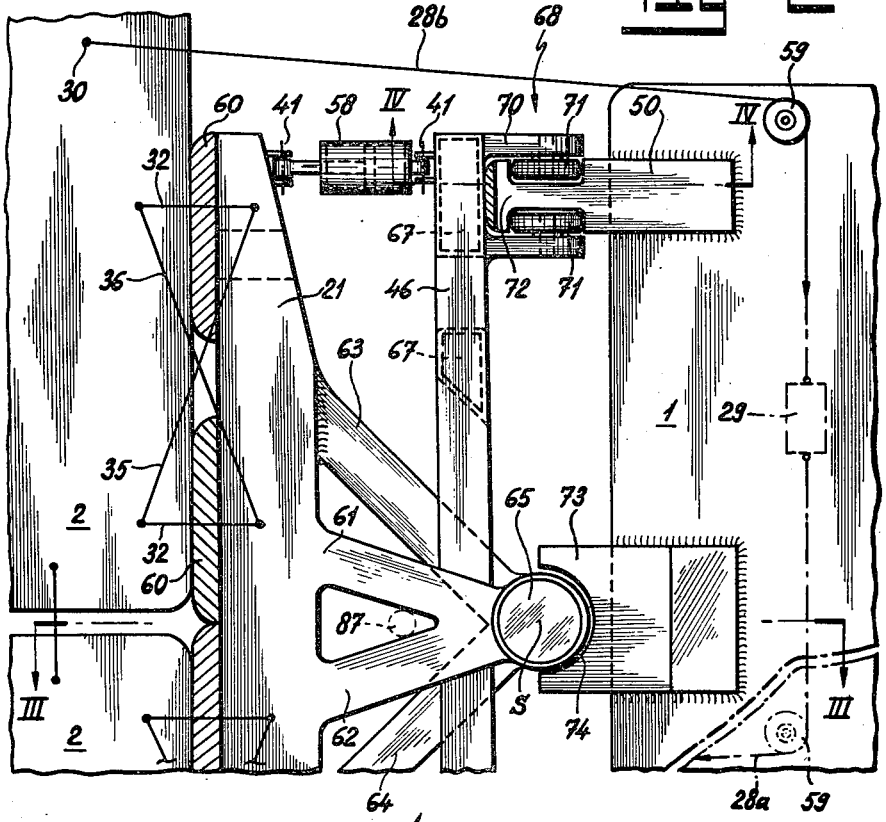
FIG. 2 illustrates a top view of a part of the steerable pushing means between a pusher tug and a barge unit.

The pushing beam with struts is able if necessary to absorb pulling forces which are transferred through the front side of the column 65 to the horizontal beams 46 and 66 of the support frame and through said support frame and the guiding elements 68 to the pushing tug 1. Also the jacks 58 and 58*a* could be used for transferring pulling forces. Notwithstanding that, it would make sense to attach the well known side wires respectively control wires 28*a* and 28*b* as is indicated in FIG. 2. One end of the wire 28*b* is attached in a point 30 to the barge 2. The wire 28*a* is attached at a corresponding point at the portside. Both wires are running through starboard rollers, respectively portside rollers 59 onto the deck of the pusher tug 1 to a device 29 which is schematically representing a compensating device. The device 29 maintains a predetermined pulling force into the wires 28*a* and 28*b*. The device however is capable to extend the length of one cable and to shorten the length of the other cable during steering maneuvers with the pushing means 20. It is also possible to couple the operation of said compensating device 29 to the control of the hydraulic jacks 58 and 58*a*.

Finally it is remarked that the support frame 46, 66, 67 may be locked onto the H-shaped guiding elements 72 by means of common known but not indicated devices after the requested elevated position is adjusted. In all cases in which the pusher tug 1 and the barges 2 have always the same draft in respect to each other, it is possible to eliminate the guiding system 68. The steering capability however will be maintained in that case.

Figure 6:
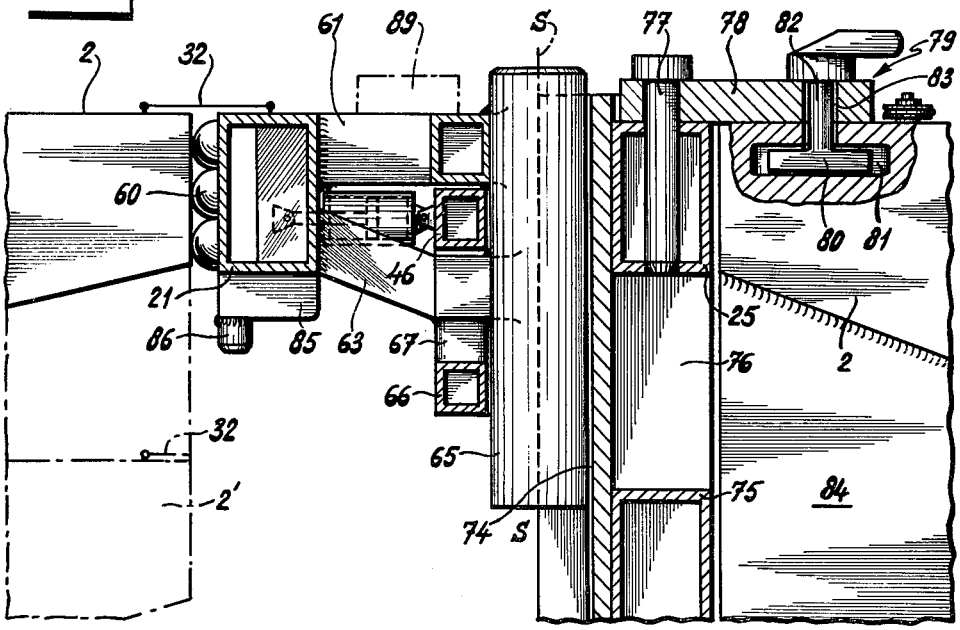
FIG. 6 illustrates a sectional view according to the line 6—6 in FIG. 5.
Figure 5:
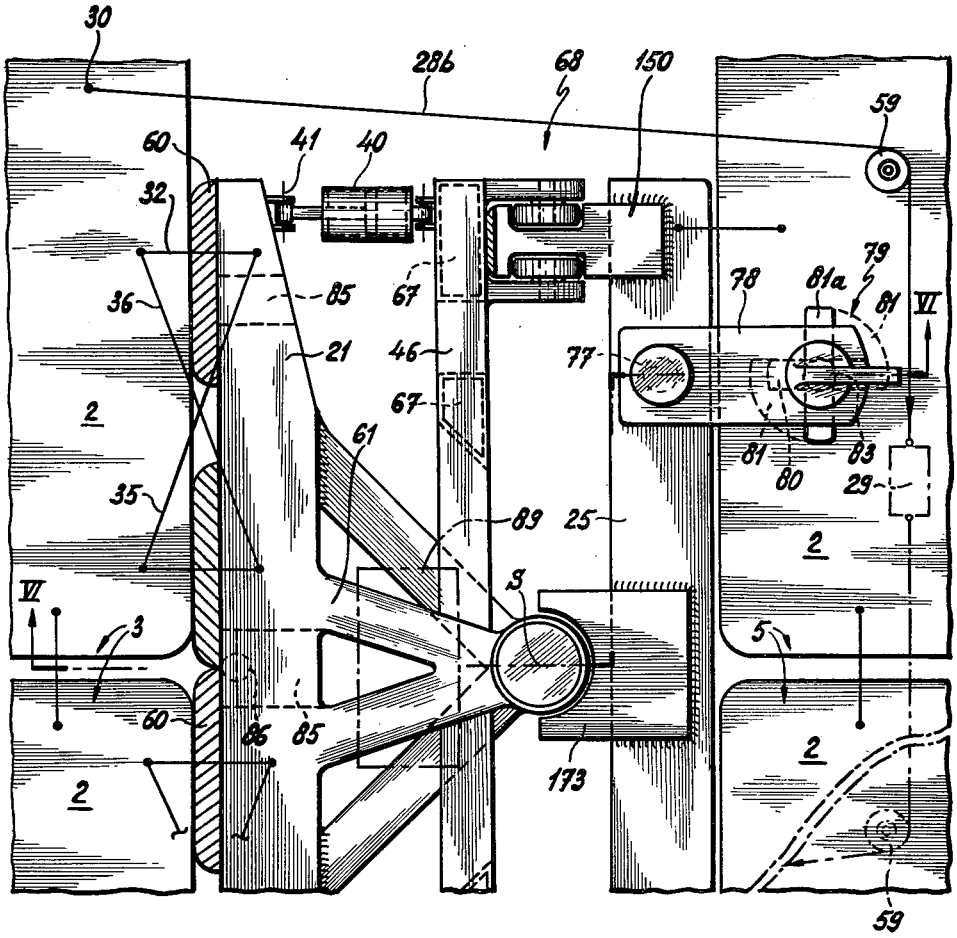
FIG. 5 illustrates a top view of a part of the steerable pushing means according to the invention positioned between two barge units.

In the FIGS. 5 and 6 pushing means 19 intended for positioning to barges or barge units is illustrated in more detail. For the most part said means are corresponding to the pushing means 20 intended for positioning onto the stem of a pushing tug 1. The corresponding parts are indicated with corresponding reference symbols. Some parts having the same function but a somewhat different shape are indicated by reference numbers enlarged by one hundred. Into the pushing means 19, the same pushing beam 21 is used and this beam is coupled in the same way to the barge 2 of the barge unit 3 by means of longitudinal wires and cross wires 32, 35, 36. The struts 61, 62, 63 and 64 are just as the column 65 corresponding. Also the support frame 46, 65, 67 is identical just as the controlling jacks 40 and 40*a*. Also the vertical guiding elements 68 are corresponding however, the starboard stemson and the portside stemson 150 are altered such, that the stemsons are suited to be mounted onto a front adapter stem 25. Said front adapter stem 25 is in the same way as the support frame 64, 65, 67 embodied as a frame and comprises a horizontal upper tube 25, a horizontal lower tube 75 and a number of vertical connecting columns 76. Like the starboard stemson and the portside stemson also the central stemson 173 is in principle identical to the stemson 73 of the pushing means 20 however adapted for mounting onto the front adapter stem 25, 75, 76. The front adapter stem forms together with the pushing beam and the support frame an integrated unit. Although this is not indicated in the figures, the winch 51 according to FIG. 4 should be mounted onto said front adapter stem to maintain the unit principal of the pushing means 19. The front adapter stem is mounted onto the deck of a barge 2 of the barge unit 5 using two horizontal carriers 78. The carrier 78 is rotatably connected to the upper side of the upper beam 25 of said front adapter stem by means of a heavy vertical pivot pin 77. The other end of the horizontal carrier 78 has a wide bore 83 into which the smaller shank 82 of a carriage bolt 80 is inserted. Said carriage bolt 80 fits with the carriage head into an wing-shaped cavity 81 below the deck of the barge. Said wing-shaped cavity 81 is communicating with the deck through an open slot 81*a*. By means of longitudinal wires 32 and cross wires the front adapter stem can be conneced firmly to the stem(s) of the barge(s) of the barge unit 4 as is indicated in FIG. 1.

To further maintain the unit principal of the pushing means 19, it is possible to install an hydraulic device with its own power unit, schematically indicated at 89 in FIG. 5, onto the pushing beam/strut combination for controlling the jacks 40 and 40*a*. Only one, for instance electrical control lead is in that case required to the steering house onto the pushing tug 1.

Because with combinations of barges it will more often happen that the stems of the coupled barges are at the same height above the water level relating to the situation between the pushing tug and the barges in front thereof, a mechanical control device for adjusting the vertical position along the guiding elements 68 could be eliminated in FIG. 5. In that case it is possible to connect the pushing beam with support frame after adjusting of the height once firm to the front adapter stem. It is also possible to maintain the guiding elements 68, whereby said elements however are adjustable using external means after which they can be locked by non indicated means.

The pushing means 19 are releasably connected to the barges with help of the connecting means 79. During loading and unloading of the barges, the relative expensive pushing means 19 are available for use elsewhere. For the transport thereof the pusher tug with his own pushing means 20 could be used. As is indicated in FIG. 3 for this purpose the upper surface 88 of the pushing beam 21 and of the struts 61 and 62 are embodied flat and furthermore at the under side of the pushing means 19 carrying elements 85 positioned into a horizontal plane are attached as schematically indicated in FIGS. 5 and 6. At the underside of the carrying surface 85 a downwards directed pin 86 is mounted, corresponding to an opening 87 into the surface 88 (FIGS. 2 and 3). If the pusher tug is now moved with his pivotable pushing means 20 until under the pivotable pushing means 19, which last mentioned means are still connected to the barge unit 4 (FIG. 1) then the horizontal surfaces become positioned above each other and the pin 86 may be inserted into the opening 87. After loosening the bolts 80, 82 of the connecting devices 79 the means 19 can be removed from the barge unit 4 by elevating the means 20, whereafter the means 19 can be transported for installation somewhere else.

Finally FIG. 5 shows a similar side wire 28 as in FIG. 2. A corresponding compensating device 29 is connected to both wires 28 on the starboardside and the portside. The function thereof corresponds to the function described in connection with the side wires 28*a* and 28*b*.

It will be clear, that in case the pushing tug 1 with its pushing means 20 is used for installing and removing the pushing means 19 on respectively from a barge unit 4, the height of the pushing means 19 can be adjusted using the pushing means 20. Driving the guiding elements 68 is in that case not necessary, and instead thereof a non indicated locking device could be used. It is also possible to simplify the guiding elements with the rollers and yet to maintain the described steering features of the pivotable pushing means according to the invention.

I claim:

1. A steerable pushing means for connecting together a combination of a pusher tug with a barge unit, said pushing means comprising:

(a) a support frame slidably connected at each end to dual side stemsons of the tug by vertically slidable means, said support frame being vertically movable relative to the tug during use;

(b) a pusher beam having a relatively flat front pusher surface rigidly connectable to a barge unit, said pusher beam having a central substantially vertical pivot column which is substantially perpendicular to the centerline of the tug and barge combination, said pivot cooperating with a substantially vertical trough portion of a central main stemson attached to the pusher tug, said pusher beam being supported by said support frame;

(c) dual vertical guiding elements located at the outer ends of said support frame and slidably connecting the support frame to said side stemsons rigidly attached to the pusher tug; and (d) extendable and retractable means flexibly connecting the outer ends of said support frame to the outer ends of said pusher beam, whereby pushing and lateral steering forces are transmitted from the tug successively through the support frame to the pusher beam and thence to the pushed barge unit.

2. Steerable pushing means according to claim 1, wherein said support frame is continuously adjustable in height along said vertical guiding elements connected to the side stemsons.

3. Steerable pushing means according to claim 1, wherein said vertical guiding elements are positioned onto the pusher tug, one element at the starboard stemson and one element at the portside stemson, which vertical guiding elements are adapted for absorbing horizontal forces in all directions.

4. Steerable pushing means according to claim 3, wherein the pusher beam is supported by means of substantially horizontal struts directed to centerline of the pusher tug where the struts are connected to the vertical pivot column which rests as a pivot shaft in said vertical trough and functioning as a counter pivot element, which trough being connected to the stem of the pusher tug by means of the central main stemson extending downwardly with a cutwater, and wherein the pusher beam vertical pivot column is pivotably locked in said trough by the support frame.

5. Steerable pushing means according to claim 4, wherein said trough is provided with a coating to prevent wear.

6. Steerable pushing means according to claim 1, wherein a portion of said support frame extends through a central portion of said pusher beam structure and thereby supports the pusher beam.

7. Steerable pushing means according to claim 1, wherein said support frame consists of two parallel horizontal beams connected together by vertical columns, and the upper beam of said frame supports said pusher beam.

8. Steerable pushing means according to claim 7, wherein said extendable and retractable means are flexibly connected between the upper horizontal beam of said support frame and the outer ends of said pusher beam.

9. A steerable pushing means for connecting together a combination of a pusher barge unit with another barge unit, said pushing means comprising:

(a) a front adapter stem having a central main stemson and dual side stemsons, said adapter stem being removably attached to a pushing barge unit by dual connecting means;

(b) a support frame slidably connected at each end to said side stemsons of said front adapter stem;

(c) a pusher beam having a relatively flat front pushing surface rigidly connectable to a barge unit, said pusher beam having a central vertical pivot column which is pivotable about a mating trough portion of said central stemson of the front adapter stem, said pusher beam being supported by said support frame;

(d) dual vertical guiding elements located at the outer ends of said support frame and slidably connecting the support frame to the dual side stemsons of said front adapter stem; and (e) extensible and retractable jack means flexibly connecting the outer ends of said support frame to said pusher beam, whereby pushing and lateral steering forces are transmitted from the pusher barge successively through the front adapter stem, the support frame to the pusher beam and thence to the pushed barge unit.

10. Steerable pushing means according to claim 9, wherein the front adapter stem is mounted onto the deck of the pusher barge unit by means of two horizontal carrying elements pivotable around a vertical shaft, whereby carriage bolts inserted with some clearance into cavities in the pusher barge form a loosable connection between the front adapter stem and the barge.

11. Steerable pushing means according to claim 9 wherein said pusher beam of the pushing means located between two barge units comprises at its underside supporting surfaces in a horizontal plane and a downwards directed pin, and an upper surface of a tug elevatable pushing means connected on to a pusher tug is substantially flat and horizontal and comprises an intake opening, whereby the pusher tug is able to remove, transport and place the pushing means destined for positioning between the barge units by using the tug elevatable pushing means, so that the horizontal surfaces are resting onto each other and the pin is inserted into the intake opening.

12. Steerable pushing means according to claim 9, wherein said front adapter stem supports the vertical guiding elements at the starboard and port sides of the barge.

13. Steerable pushing means according to claim 9, wherein said extendable and retractable means are oppositely operated hydraulic pistons, and a hydraulic power unit is provided on the pushing means for operating the hydraulic pistons.

14. Steerable pushing means according to claim 9, wherein said support frame extends through a central portion of said pusher beam structure and thereby supports the pusher beam.

15. A pusher tug and multiple barge unit combination, comprising:

(a) a pusher tug equipped with propelling and steering means;

(b) a first steerable pushing means attached to the front end of said tug, said pushing means consisting of a substantially horizontal support frame connected to the tug stem, said support frame being slidably connected in height relative to the tug and adapted to support and guide a pushing beam pivotable about a vertical shaft and positioned substantially perpendicular to the centerline of said tug, with hydraulic steering jacks being positioned between the support frame and the pushing beam at their outer ends;

(c) a first barge unit rigidly connected to the front end of said first steerable pushing means;

(d) a second steerable pushing means rigidly attached to the front end of said first barge unit by a front adapter stem, which adapter stem in turn supports said second steerable pushing means consisting of a substantially horizontal support frame connected to the front adapter stem, said support frame adapted to carry and guide a pushing beam pivotable about a vertical shaft and positioned substantially perpendicular to the centerline of said first barge unit, with hydraulic steering jacks being positioned between the support frame and the pushing beam; and (e) a second barge unit rigidly connected to the front end of said second steerable pushing means.

16. A method for connecting a steerable pushing means onto a barge unit, comprising (a) providing a first pushing means having vertically adjustable guide means and having an opening on its upper side and being attached to a tug boat;

(b) placing said first pushing means under a second pushing means having a downwardly directed pin on its lower side and being attached to a barge unit;

(c) loosening attachment means between said second pushing means and the barge unit and lifting said second pushing means from the barge by raising said guide means on said first pushing means; and (d) transporting said second pusher means to another barge unit and installing the second pusher means thereon.

17. The method of claim 16, wherein said second pushing means is installed onto the second barge unit by dual connecters.

18. Pusher tug and multiple barge combination according to claim 15, wherein said barge unit comprises multiple parallel barges rigidly connected together.

19. Pusher tug and multiple barge combination according to claim 15, wherein said control wires are provided connecting the tug and the barge unit.

20. Pusher tug and multiple barge combination according to claim 15, wherein side control wires are provided connecting the two barge units.

* * * * *